United States Patent [19]

Hegemann et al.

[11] 4,415,142

[45] Nov. 15, 1983

[54] APPARATUS FOR HANDLING CONVERTER GAS

[75] Inventors: Karl-Rudolf Hegemann, Essen-Bergerhausen; Helmut Weissert, Bochum-Hiltrop; Kurt Hinsken, Mülheim, all of Fed. Rep. of Germany

[73] Assignee: Gottfried Bischoff Bau Koml. Gasreinigungs- und Wasserruckkühlanlagen GmbH & Co. KG, Essen, Fed. Rep. of Germany

[21] Appl. No.: 327,500

[22] Filed: Dec. 4, 1981

[51] Int. Cl.[3] ..... C21C 5/40

[52] U.S. Cl. ..... 266/89; 75/60; 266/144; 266/147; 266/157; 266/158

[58] Field of Search ..... 75/60; 266/80, 89, 90, 266/147, 144, 157, 158, 159

[56] References Cited

U.S. PATENT DOCUMENTS 3,617,043 11/1971 Hirao ..... 266/144
3,697,229 10/1972 Frey et al. ..... 266/144
4,054,274 10/1977 Hogner ..... 266/158
4,218,241 8/1980 Hegemann et al. ..... 75/60

FOREIGN PATENT DOCUMENTS 1433571 12/1968 Fed. Rep. of Germany .

OTHER PUBLICATIONS

Perry, R., et al.; *Chemical Engineers Handbook*, 5th Edition, McGraw Hill, pp. 6–54 to 57, TP155P4 (1973).

*Primary Examiner*—Michael L. Lewis
*Attorney, Agent, or Firm*—Karl F. Ross; Herbert Dubno

[57] ABSTRACT

An apparatus for the handling of converter gases, especially the storage thereof, comprises a hood which fits over the mouth of a steel making converter and is connected by a duct and blower to a storage vessel. According to the invention, between the blower and the storage vessel, a cruciform junction is provided with the lower upwardly extending stretch being connected to the discharge side of the blower, the upper upwardly extending stretch being connected to a flaring pipe, one horizontal stretch being connected to the storage vessel and the other horizontal stretch to a bypass to the flaring pipe. Valves are provided for controlling the flow such that only the valuable gas is stored.

4 Claims, 2 Drawing Figures

APPARATUS FOR HANDLING CONVERTER GAS

CROSS REFERENCE TO RELATED APPLICATION

The present application is related to the commonly assigned copending application Ser. No. 321,071 filed Nov. 13, 1981 by two of the present joint inventors, based upon German application No. P 30 43 127.7 filed Nov. 15, 1980.

FIELD OF THE INVENTION

Our present invention relates to the operation of steel-making converters and, more particularly, to an apparatus for handling the gases generated in the operation of steel-making converters and especially for the storage of such gases.

BACKGROUND OF THE INVENTION

The handling of metallurgical plant gases and especially the gases produced in steel-making plants is a well developed art and reference may be made, in this connection, to the following U.S. Pat. Nos. 3,799,520, 4,007,025, 4,055,331, 4,052,042, 4,123,238, 4,145,193, 4,152,123, 4,218,241
as well as to commonly assigned copending applications Ser. No. 198,042 filed Oct. 17, 1980 (now U.S. Pat. No. 4,316,727) and Ser. No. 281,346 filed July 8, 1981. The related application, moreover, describes the recovery of converter gases and certain principles in the operation of a top-blown steel-making converter which are relevant here as well.

In the operation of a top-blown steel-making converter, the refractory-lined upwardly open vessel, which is generally swingable on trunnions about a horizontal axis, can receive a charge of pig iron and scrap. The charge is blown by one or more methods (e.g. top blowing, side blowing or bottom blowing) to decarbonize, desulfurize and dephosphorize the charge.

The blow usually takes place in a number of phases, e.g. a preignition predecarbonization phase in which oxygen or air is blown into or onto the charge and may react in part therewith without strong evolution of carbon oxides, decarbonization phases in which carbon dioxide and carbon monoxide are evolved to a significant degree and post decarbonization phases during which other reactions are carried out to generate still further gaseous components.

In gases which are thus produced are commonly collected by a hood which is lowered to the mouth of the converter when the latter is swung into a more or less upright position for the blow. This hood is connected to the intake side of the blower which draws the evolved gases away from the mouth of the converter.

The gas handling equipment can include gas cleaning units, e.g. scrubbers, cyclones and filters, flaring pipes at which combustible undesirable gases are burnt as they are discharged into the atmosphere and a gas storage vessel in which a portion of the converter gas can be stored for use subsequently, e.g. because of its heat value or to recover valuable components therefrom or for other purposes in the metallurgical process.

In an apparatus or plant of the type with which the present invention is concerned, therefore, a hood can be provided for an oxygen blown converter and can communicate with a blower, flaring stack and storage vessel adapted to collect converter gas which satisfies certain conditions, hereinafter referred to as storage conditions.

The suction side of the blower is connected to the hood and the pressure side of the flaring stack and to the storage vessel, switch-over valves being provided to allow selective discharge of the gases from the blower into the flaring stack and the vessel.

Between the storage stack and the vessel a check valve is provided (to prevent backflow from the vessel to the stack and loss of the stored component), the switch-over device being provided with measuring and control units responsive to the appearance of the storage requirements for switching over between gas flaring and gas storage.

During the storage operation, the flaring stack is cut off and during flaring operations flow to the storage vessel is blocked. The measuring and control devices can include gas analyzers to respond continuously to the composition of converter gas and especially to the oxygen and carbon monoxide contents thereof.

The storage conditions thus can include: an oxygen content less than a maximum permissible level, a carbon monoxide content greater than a minimum permissible level, a storage volume at least sufficient for a blowing period, problem-free operation of the oxygen blowing means (e.g. a top blowing lance), and available storage time greater than the minimum permissible value.

Outside these conditions or under circumstances which do not satisfy them, switch over from flaring to storage does not occur.

In specific terms, the output from the blower is branched and each branch is provided with an open/-close or bistable valve having solely the capacity to completely open or completely block a flow cross section.

For flaring operation the open/close or, more simply designated, on/off valve is opened and the on/off valve of the vessel is closed. For storage operation the reverse is the case.

The switchover from flaring operation to storage operation has been found to create difficulties especially when it is not possible to ascertain precisely when, during the blowing process, the switchover from one stage to the other is required. This is because the pressure and volume flow rates of the converter gases fluctuate widely during a blowing period and because it is only possible to feed to the storage vessel converter gas which is at higher pressure than the pressure in the storage vessel.

OBJECTS OF THE INVENTION

It is the principal object of the present invention, therefore, to provide an improved gas-handling system for a steel-making converter whereby the disadvantages of earlier systems are avoided.

Still another object of the invention is to provide an apparatus for the storage of converter gases which will permit switchover between storage and flaring operations to be more precise and, specifically, which will ensure storage only of gas when the predetermined storage conditions are satisfied and flaring of gas only when these conditions are not satisfied.

SUMMARY OF THE INVENTION

These objects and others which will become apparent hereinafter are attained, in accordance with the present invention, in a gas-handling system for a steel-making converter which comprises a hood communicating with the converter mouth and drawing converter gas therefrom, a blower having an intake side connected to the hood for evacuating the converter gases from the region of the converter mouth, a flaring stack communicating with the discharge side of the blower, and a storage vessel for receiving gas from the discharge side of the blower.

According to this invention, a T-connection is provided between the discharge side of the blower, and the stack and the storage vessel such that one arm of the T communicates with the blower, an opposite arm of the T communicates with the stack and the third arm of the T is connected to the storage vessel. In the second or stack arm, we provide a throttle valve while in the third or vessel arm we provide an on/off valve, and, for control of these valves, a control and sensing arrangement such that at the beginning of storage operation and during the transition from storage operation to flaring operation, the setpoint for the throttle valve is determined by the gasometric pressure but is zero during flaring operation.

Reference will be made herein to gasometric operation or the gasometer pressure, this term being utilized to describe operation in which pressure and composition are both closely monitored to ensure the maintenance of the aforementioned storage conditions.

Specifically, therefore, the gasometer includes the storage vessel and the pressure in the gasometer will be understood to mean the pressure in this storage vessel together with the sum of all pressure drops extending to the storage vessel, i.e. from the on/off valve of the T through the check valve and in the duct leading to the storage vessel.

The requirements expressed above thus mean that during gasometer operation, i.e. during the switchover from storage operation, the setpoint value is the sum of the gasometer pressure and all other pressure drops leading to the gasometer.

It has been found to be advantageous to provide the T-connection with a further arm or branch, e.g. opposite the vessel branch, which is connected by a safety valve directly to the flaring stack downstream of the throttle valve. Best results are obtained when the safety valve is a flap-type valve.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
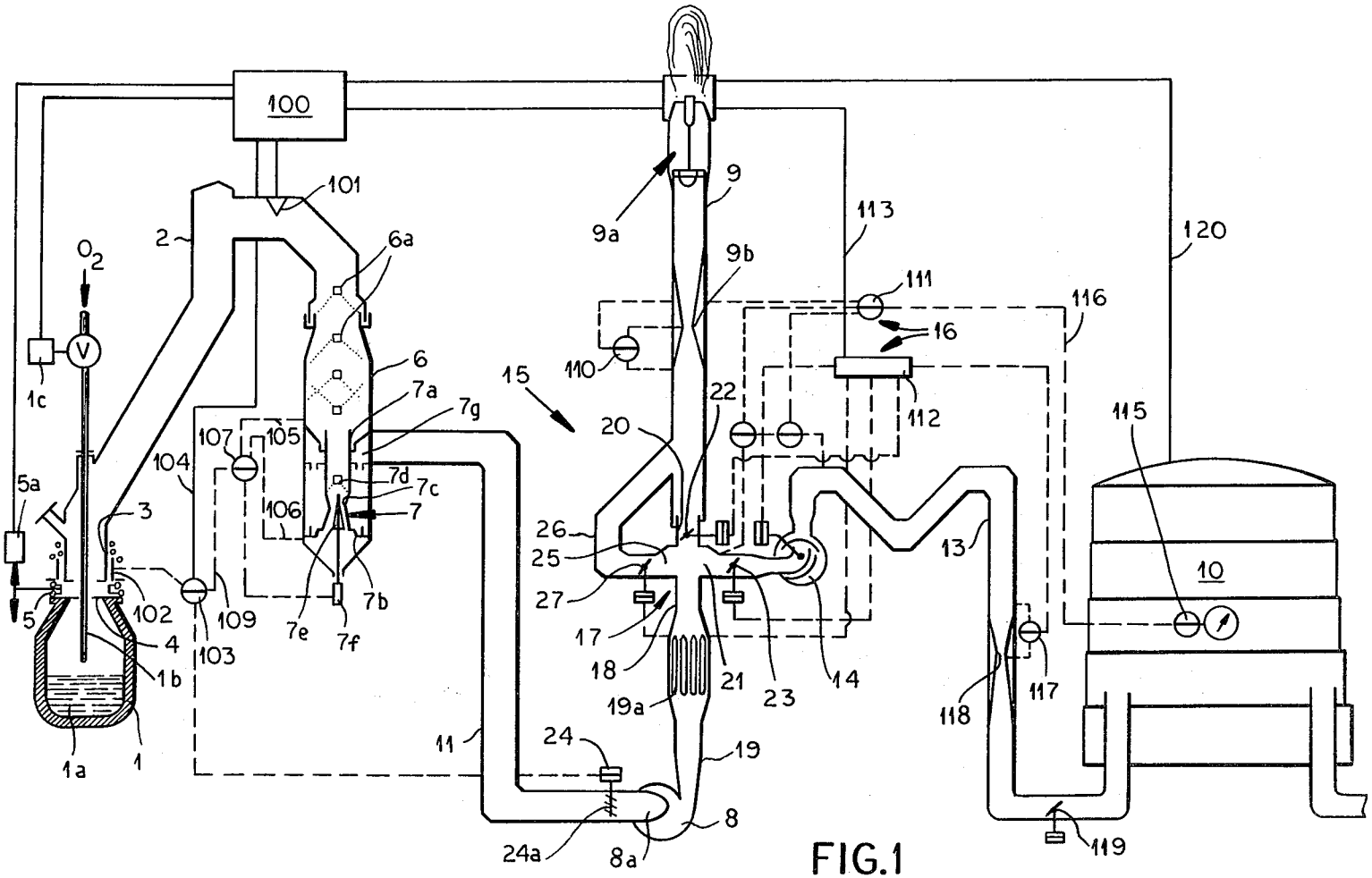
FIG. 1 is a flow-diagram of an apparatus for the storage of converter gases according to the invention.

In FIG. 1 of the drawing we have shown a top-blown converter 1, illustrated in its erect position, containing a charge 1*a* and having an upwardly open converter mouth 4 onto which a ring 5 of the hood 3 may be lowered during the blowing operation.

Hood 3 is connected by the converter stack 2 to a scrubbing column 6.

While the operation of the converter 1 will now be described in detail herein and features of this operation are disclosed in the above-mentioned related application, it suffices to note that the charge 1*a* of the converter 1, which consists of molten pig iron and scrap is top blown by oxygen directed at this charge from a lance 1*b* which is lowered through the hood toward the charge by any conventional means, e.g. the lance handling system described at pages 486 ff. of *The Making, Shaping and Treating of Steel,* U.S. Steel Co., Pittsburgh, PA, 1971. This work also describes the chemistry and mechanism of the operation of the top-blown converter.

The ring 5 of the hood 3, both of which may be water cooled, can be raised and lowered by an actuator 5*a* automatically by the controller 100 which can respond to a change in the composition of the gases detected by any conventional gas analysis unit 101 connected to the stack. The controller 100 also operates the valve 1*c* for admitting oxygen through the lance 1*b*. An input to the controller 100 is provided by a temperature measurement probe 102 which reaches into an annular compartment around the hood 3 and within a water seal formed between this hood and the ring 5 as described in the aformentioned related application.

Essentially, therefore, the control 100, at the start of the blow, opens the oxygen supply and permits a blower 8 to draw gas from the hood while the ring 5 is somewhat spaced from the converter. Only after the decarbonization begins, as determined by detection of carbon oxides, for example, by the gas analyzer 101, an indication of ignition is the ring closed.

Upstream of the blower 8, we can provide a gas-cleaning column 6 which is traversed downwardly by the gases and scrubs the latter with water sprayed into the gas from nozzles or heads 6*a*.

The scrubbing is augmented by an annular gap scrubber 7, as described in the aforementioned patents, this scrubber simultaneously serving to control the pressure drop in the washing unit 6, 7 and hence the negative pressure generated by the blower 8.

More specifically, the annular gap scrubber 7 comprises a duct 7*a* which is coaxial with the column 7 and has a downwardly widening section 7*b* beyond the construction 7*c* into which water is sprayed by a nozzle 7*d*. A conical body 7*e* is movable axially in the flared portion 7*b* by the servomotor 7*f* to control the flow cross section through this scrubber, i.e. by regulating the gap width.

From the annular gap, the gases flow upwardly to collect in an annular compartment 7*g* from which the duct 11 leads to the intake side 8*a* of the blower 8.

The blower 8 is of the adjustable throughput type and can be driven by an electric motor. The throughput is shown to be controllable by the controller 24 which, in the embodiment illustrated, regulates the position of the vanes 24*a* upstream of the blower intake or at the blower intake. Instead, the controller 24 can regulate the speed of the blower, the pitch of blades on the blower impeller or the like.

As described in the aforementioned related application the pressure detected at 102 can be applied, e.g. through a proportional controller 103 directly to the member 24 under the control of an input 104 from the central controller 100 such that, once the central control 100 has closed the ring during the decarbonization phase, the pressure detected at 102 serves as an actual value signal for regulating the rate at which gases are drawn by the blower 8 from the converter. The latter rate is held substantially equal to the rate at which gases are evolved by the converter.

Of course, the rate at which gases are drawn from the hood 3 by the blower 8 also (alternatively or in addition) can be controlled by superimposing an input on the self-regulation of the gap in the annular gap scrubber 7.

To this end, the pressure drop is measured at 105, 106 across the annular gap and is applied as an input at proportional controller 107 which normally operates the servomotor *7f* to maintain this pressure drop constant by adjusting the gap to suit the flow velocity. When the gas is used in part to control the rate at which gases are drawn from the hood an input 109 is supplied to the controller 107 to carry signals from the pressure sensor 102 to this controller as well.

The blower 8 has its discharge side 19 provided with a waste heat recovering heat exchanger 19*a* and is in communication with an upwardly extending branch 18 of a T-connection 17 whose opposite branch 22 communicates with a flaring stack 9 provided with the usual filling head 9*a* adapted to ignite combustible gases as they emerge at the mouth of the stack which can have the usual flash-back arrestors.

A venturi throttle 9*b* in this stack is provided with a pressure drop detector 110 whose input is supplied, as a measure of rate of flow, to the input member 111 for a controller 112, members 111 and 112 forming part of a measuring and control system also receiving the input 113 from the controller 100 and represented generally at 16.

A third branch 21 of the T-connection is connected via a check valve 14 which can be of the water-filled type (see FIG. 2), and a branch 13 to the storage vessel 19 representing a gasometer whose pressure is detected at 115 with the output signal being applied to controller 16 as represented by the line 116.

The rate of flow of the gas to the gasometer is detected by a sensor 117 responsive to the pressure drive across the venturi throttle 118 in the duct 113 which can be provided with a further safety valve 119 closed by automatic means in the event of a failure somewhere and not otherwise described.

The stack 9 and the vessel 10 are used alternatively. Thus when the gas from the converter is received under the aforementioned storage conditions, it is fed to the storage vessel 10 but if received under other conditions is flared from the stack 9*a*.

The switch-over means for storage and flaring has been represented generally at 15 and responds to the measuring and control device 16 as will be described in greater detail below. The establishment of the storage conditions is effected by control unit 100 which responds to the gas analysis in the manner previously described, the available storage volume via the control line 120 and the duration of the blow period by internal timing.

The switch-over means 15 comprises the T-connection 17, previously described in part, one arm of which includes the branch 18 connected with the pressure side of the blower 8 via the duct 19 while the opposite arm is constituted by branch 20 leading to the flaring stack 9.

The remaining arm 21 is connected via the duct 13 to the gas storage vessel 10. This relationship is shown in greater detail in FIG. 2.

Thus the branch 20 leading to the stack 9 is provided with a throttle valve 22 whose operator 121 is actuated by the controller 112 in response to a set-point value established by this controller. The branch 21 is provided with a two-position or bistable open/close valve 23 whose operator 122 is actuated by the controller 112 as well.

For initiation of storage operation and for switch-over to flow operation, the throttle valve 22 serves as a control valve for the pressure upstream of the valve 23 which is detected as represented by line 123 and is applied to the pressure sensor 124 with the signal delivered at 125 through the controller 111 to the controller 112 so that summing of the gasometer pressures can be effected.

Another pressure input is provided at 126 to the sensor 127 which also feeds its signal, derived from downstream of a check valve 14 operated by the actuator 128 to the control circuit 16.

Initially the throttle valve 22 is controlled utilizing the pressure of the gas in the vessel 10 as a setpoint value. The valve 22 throttles the gas flow to the filling stack 9 as long as the pressure ahead of the valve 22 and ahead of the valve 24 is greater than the pressure of the gas in vessel 10 plus losses to this vessel. The rate at which the valve 22 adjusts is such that the suction regulation by controller 24 of the blower is not affected. Upon attainment of this setpoint value, the check valve 14 is opened and thereafter the bistable valve 23 is opened. At this point there is pressure equalization across the valve 23 so that converter gas does not yet flow to the vessel 10.

The throttle valve 22 then closed completely and storage operation begins. If the gas analyzer or the controller 100 signals a deviation from the storage conditions or the end of the storage operation, e.g. because one or more of the storage conditions no longer are fulfilled, the throttle valve 22 again responds to the setpoint value of the pressure in the gas storage vessel 10. Since the pressure head of the valve 22 during storage is greater by the pressure drawn in duct 13 than the pressure in the gas storage vessel 10, the throttle valve 22 opens to restore balance and thereby reduces the flow to the vessel 10, flaring the excess. When this stage is reached, the valves 23 and 14 close in succession.

The throttle valve 22 again opens fully and storage operation is concluded and the system operates exclusively in a flaring mode although storage operation can be resumed as soon as the conditions are again met.

Figure 2:
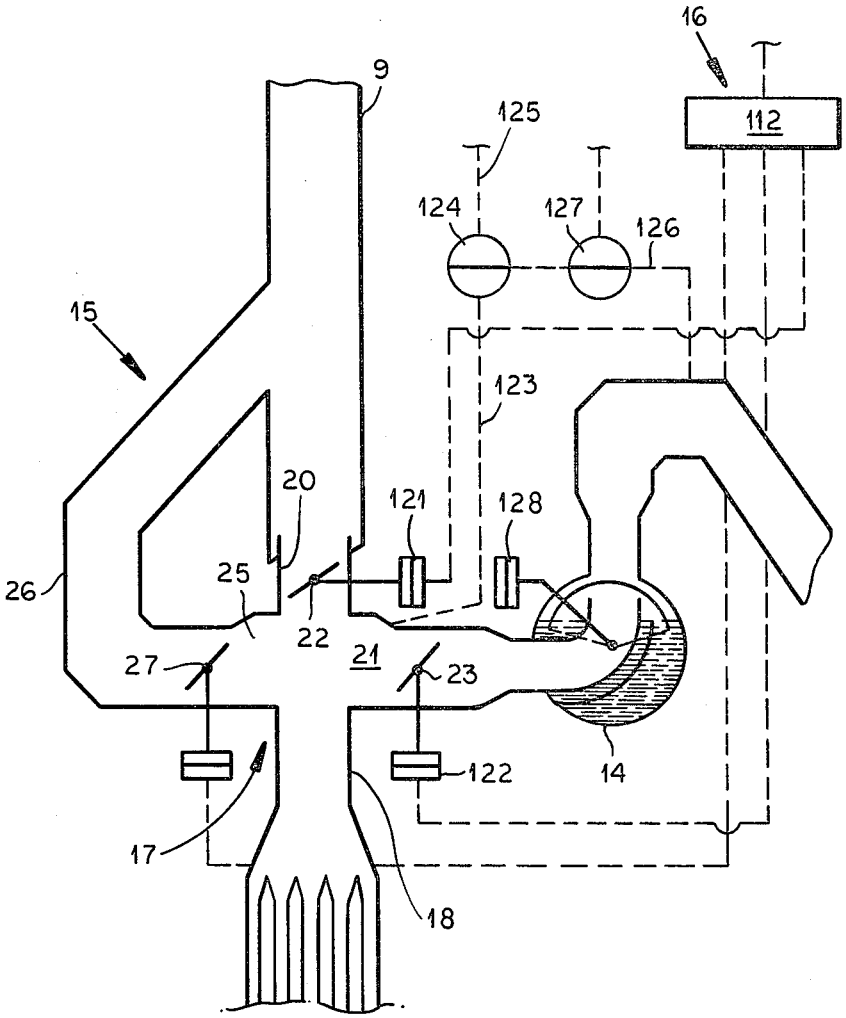
FIG. 2 is a detail view of the T-connection of this apparatus.

As can be seen especially from FIG. 2, a further branch 25 of the T-connection has a safety valve 27 operated by the controller 16 and connected to a bypass 26 across the valve 22, i.e. to the flaring stack downstream of valve 22. Both th valve 23 and the safety valve 27 can be flap valves. The safety valve is normally closed and is automatically opened should the pressure received be detected in the T-connection upstream thereof or elsewhere under conditions which prevent effecting venting through the valve 22 or transfer to the storage vessel through the valve 23.

We claim:

1. A gas handling plant for an oxygen blown steel-making converter comprising:

a gas collection hood adapted to communicate with the mouth of a steel-making converter for receiving converter gas therefrom;

a blower having an intake connected with said hood and an outlet for drawing said gas from said hood and forcing said gas from said outlet;

a T-connection having a first branch connected to said outlet, a second branch opposite said first branch, and a third branch;

a flaring stack connected to said second branch;

a storage vessel connected to said third branch by a duct provided with a check valve;

a throttle valve in said second branch;

an open/close two-position valve in said third branch; and control means responsive to pressure in said storage vessel, pressure in said T-connection and pressure drop in said duct for controlling said throttle valve during initiation of gas storage to establish pressure balance across said two-position valve prior to the opening thereof upon the establishment of a predetermined set of gas storage conditions and for establishing equilibrium between the sum of said pressure drops and the pressure in said vessel with the pressure in said T-connection prior to closing of said two-position valve for flaring operation, said throttle valve being fully opened for flaring operation, said control means being responsive to the pressure in said vessel and forming a setpoint value for said throttle valve during gas storage and for forming a setpoint value of zero for flaring operation.

2. The plant defined in claim 1 wherein said T-connection is formed with a further branch communicating with said stack downstream of said throttle valve and formed with a safety valve operated to bypass said throttle valve.

3. The plant defined in claim 2 wherein at least one of said valves is a flap valve.

4. The plant defined in claim 1 or in claim 2 wherein an annular gap scrubber is provided between said intake and said hood.

* * * * *